US007661935B2

(12) United States Patent
Kellar et al.

(10) Patent No.: US 7,661,935 B2
(45) Date of Patent: Feb. 16, 2010

(54) HIGH PRESSURE PUMP

(75) Inventors: Franz W. Kellar, Gastonia, NC (US); Donald G. Faulkner, Charlotte, NC (US)

(73) Assignee: Kinemax Pump Systems LLC, Gastonia, NC (US)

( * ) Notice: Subject to any disclaimer, the term of this patent is extended or adjusted under 35 U.S.C. 154(b) by 721 days.

(21) Appl. No.: 11/059,856

(22) Filed: Feb. 17, 2005

(65) Prior Publication Data

US 2006/0182640 A1 Aug. 17, 2006

(51) Int. Cl.
*F04B 19/02* (2006.01)
*F04B 27/06* (2006.01)

(52) U.S. Cl. ..... 417/464; 417/271; 417/273

(58) Field of Classification Search ..... 417/269, 417/271, 273, 460, 464
See application file for complete search history.

(56) References Cited

U.S. PATENT DOCUMENTS

| | | | | | |
|---|---|---|---|---|---|
| 110,936 | A | | 1/1871 | Sheldon | |
| 915,759 | A | * | 3/1909 | Foll | 92/66 |
| 1,120,998 | A | * | 12/1914 | Canode | 417/451 |
| 1,159,066 | A | | 11/1915 | Moore | |
| 2,151,402 | A | | 3/1939 | Burch | |
| 2,347,663 | A | | 5/1944 | Carnahan | |
| 2,502,334 | A | | 3/1950 | Melchior | |
| 2,624,284 | A | | 1/1953 | Straub | |
| 2,642,748 | A | | 6/1953 | Widmer | |
| 2,660,493 | A | | 11/1953 | Flick | |
| 2,673,028 | A | | 3/1954 | Cornelius et al. | |
| 2,844,425 | A | | 7/1958 | Muller | |
| 2,934,363 | A | | 4/1960 | Knox | |
| 3,227,094 | A | | 1/1966 | Cailloux | |
| 3,323,467 | A | | 6/1967 | Heintz | |
| 3,338,170 | A | | 8/1967 | Swartz | |
| 3,601,419 | A | | 8/1971 | Fern | |
| 3,665,816 | A | | 5/1972 | Caudle | |
| 3,790,310 | A | | 2/1974 | Whelan | |
| 3,945,766 | A | | 3/1976 | Gelon | |
| 4,026,322 | A | | 5/1977 | Thomas | |
| 4,103,594 | A | | 8/1978 | Geffroy et al. | |
| 4,304,531 | A | | 12/1981 | Fisher | |
| 4,310,290 | A | | 1/1982 | Dantlgraber et al. | |
| 4,371,001 | A | | 2/1983 | Olsen | |
| 4,389,168 | A | | 6/1983 | Yannascoli et al. | |
| 4,464,567 | A | | 8/1984 | Reilly et al. | |
| 4,536,135 | A | | 8/1985 | Olsen et al. | |
| 4,683,806 | A | * | 8/1987 | Ryzner | 92/66 |
| 4,717,317 | A | | 1/1988 | Hofer | |
| 4,780,064 | A | | 10/1988 | Olsen | |

(Continued)

*Primary Examiner*—Devon C Kramer
*Assistant Examiner*—Patrick Hamo
(74) *Attorney, Agent, or Firm*—Trego, Hines & Ladenheim, PLLC

(57) ABSTRACT

An ultrahigh pressure pump includes a frame including at least one radially-extending member having an outer frame pivot disposed at outer end thereof; a crank rotatably mounted in the frame and adapted to be driven by a power source and a crank pin offset from a rotational axis of the crank; and at least one radially-extending telescoping pump subassembly having inner and outer ends. The outer end of each pump subassembly is attached to the outer frame pivot for pivotal swinging movement thereabout, and the inner end is pivotally attached to the crank pin. The pump subassembly operates substantially free from side loads on the piston rod and has a long component life.

14 Claims, 12 Drawing Sheets

U.S. PATENT DOCUMENTS

| | | | | |
|---|---|---|---|---|
| 4,822,255 | A | 4/1989 | Eickmann | |
| 4,957,416 | A * | 9/1990 | Miller et al. | 417/273 |
| 5,037,277 | A | 8/1991 | Tan | |
| 5,050,892 | A | 9/1991 | Kawai et al. | |
| 5,380,159 | A | 1/1995 | Olsen et al. | |
| 5,472,367 | A | 12/1995 | Slocum et al. | |
| 5,493,954 | A | 2/1996 | Kostohris et al. | |
| 5,508,596 | A | 4/1996 | Olsen | |
| 5,892,345 | A | 4/1999 | Olsen | |
| 2003/0122322 | A1 | 7/2003 | Tremoulet, Jr. et al. | |

* cited by examiner

Fig. 13
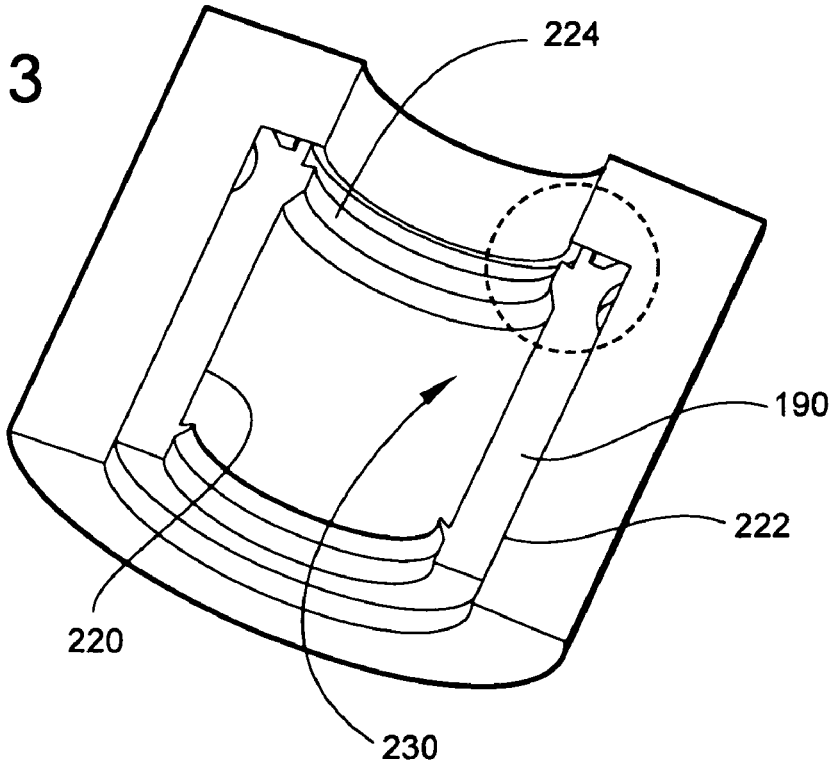
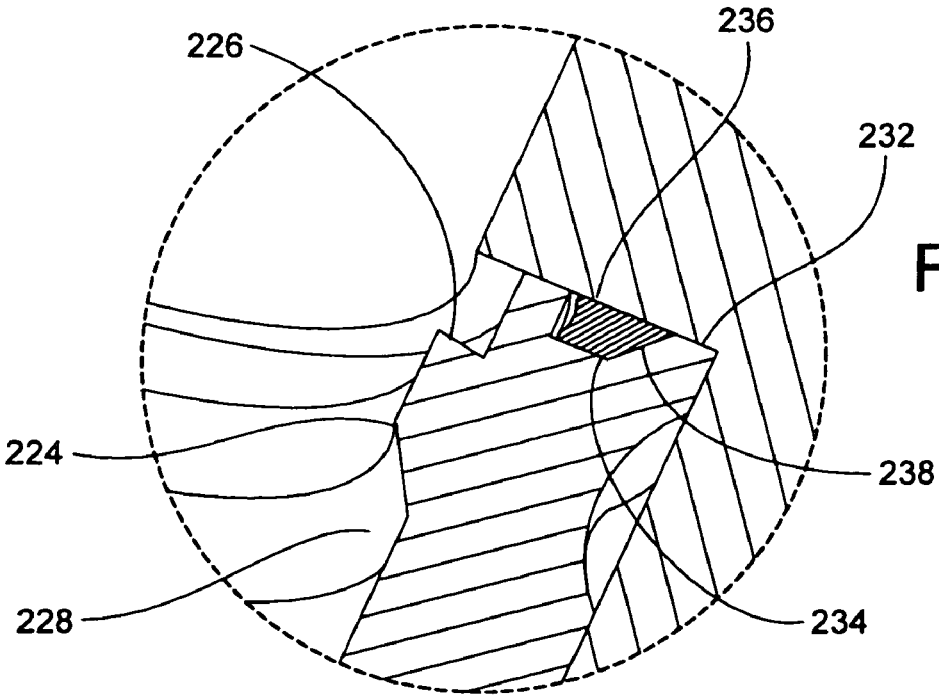
Fig. 14

HIGH PRESSURE PUMP

BACKGROUND OF THE INVENTION

This invention relates generally to ultrahigh-pressure pumps and more particularly to a piston-type ultrahigh pressure pump.

Ultrahigh pressure pumps are used for many industrial applications, for example for waterjet cutting and textile manufacturing. An ultrahigh-pressure pump delivers liquid flow at extremely high pressures, e.g. more than about 207 MPa (30,000 psi). There are two broad classes of pumps used to produce these pressures in the prior art, namely intensifier pumps which utilize a hydraulically-operated set of intensifier pistons to pressurize water to ultrahigh-pressure levels, and crank-operated piston pumps which are similar in construction to automobile engines. Intensifier pumps operate at relatively low efficiency, for example about 60%. Crank pumps are more efficient, but have relatively low service lives.

Accordingly, there is a need for an ultrahigh-pressure pump which combines high efficiency and high component life.

BRIEF SUMMARY OF THE INVENTION

Therefore, it is an object of the invention to provide an ultrahigh-pressure pump having long component life.

It is another object of the invention to provide an ultrahigh-pressure pump having a pump cylinder and piston which operate substantially free of lateral loads.

It is another object of the invention to provide a robust high pressure seal for an ultrahigh-pressure pump.

These and other objects are met by the present invention, which according to one embodiment provides an ultrahigh pressure pump, including: a frame including at least one radially-extending member having an outer frame pivot disposed at outer end thereof; a crank rotatably mounted in the frame, the crank including a driveshaft having an input shaft adapted to be driven by a power source and a crankpin offset from a rotational axis of the crank; and at least one radially-extending telescoping pump subassembly having inner and outer ends and including: a cylinder having an inner bore and a piston rod received in the bore, wherein the outer end is attached to the outer frame pivot for pivotal swinging movement thereabout, and the inner end is pivotally attached to the crankpin, whereby the piston rod can reciprocate relative to the inner bore substantially without side loads thereupon.

According to another embodiment of the invention, each of the pump subassemblies includes: an outer member having an inner end and an outer end, the outer end carrying an outer pump pivot and the inner end defining a cylinder having an inner bore formed therein; and an inner member having an inner pivot disposed at a radially inner end thereof, a radially outwardly extending piston rod, and a coaxial outer sleeve surrounding the piston rod in spaced-apart relationship thereto. The piston rod is received in the inner bore and the cylinder is received in the outer sleeve.

According to another embodiment of the invention, the outer member further includes: a laterally-extending crossbar disposed at a radially outer end of the cylinder, the crossbar having a crossbore formed therethrough with an inlet at one end and an outlet at the other end, the crossbore being disposed in fluid communication with the inner bore; an outlet check valve disposed in fluid communication with a first end of the crossbore and operative to allow fluid flow in a discharge direction but to prevent fluid flow in an opposite direction; and an inlet check valve disposed in fluid communication with a second end of the crossbore and operative to allow fluid flow in an intake direction but to prevent fluid flow in an opposite direction.

According to another embodiment of the invention, the pump of further includes a discharge tube assembly connected to the outlet check valve. The discharge tube assembly includes: a hollow first block connected to the outlet check valve; a hollow second block spaced away from the first block and adapted to be connected to discharge piping downstream of the pump; and a tube connecting the first and second blocks, the tube being formed into a coil having a plurality of turns, such that the first block may move about the outer frame pivot in unison with the pump subassembly while the second block remains stationary.

According to another embodiment of the invention, the cylinder includes a liner assembly including: a cylindrical inner liner which defines the inner bore; and a cylindrical outer liner surrounding the inner liner, wherein the outer liner is assembled to the inner liner with a preselected interference fit so as to induce a compressive preload in the inner liner.

According to another embodiment of the invention, the inner liner has a length which is greater than that of the second liner.

According to another embodiment of the invention, the pump further includes a high-pressure seal carried at a radially inner end of the cylinder for preventing fluid leakage between the piston rod and the inner bore, the high-pressure seal including an inner wall having a first diameter larger than an outside diameter of the piston rod. The inner wall includes: a circumferential first sealing band having a second diameter smaller than the outside diameter of the piston rod, so as to create a preselected interference between the first sealing band and the piston rod; an axially-facing first annular surface joined to an upper end of the first sealing band; and an angled, circumferential first tapered surface joined to a lower end of the first sealing band, so as to define an annular first relief zone between the piston rod and the first tapered surface.

According to another embodiment of the invention, the pump further includes means for removing working fluid from the first relief zone.

According to another embodiment of the invention, the pump further includes a drain system for receiving working fluid from the first relief zone, and means for quantifying the amount of working fluid removed from the first relief zone.

According to another embodiment of the invention, the pump further includes means for supplying a lubricant to the first relief zone.

According to another embodiment of the invention, the inner wall of the high-pressure seal further includes: a circumferential second sealing band axially spaced-away from the first sealing band and having a third diameter smaller than the outside diameter of the piston rod, so as to create a preselected interference between the second sealing band and the piston rod; an axially-facing second annular surface joined to an upper end of the second sealing band; and an angled, circumferential second tapered surface joined to a lower end of the second sealing band, so as to define an annular second relief zone between the piston rod and the second tapered surface.

According to another embodiment of the invention, the pump includes a plurality of pump subassemblies, the subassemblies being disposed in a radial array around the crank.

According to another embodiment of the invention, the pump includes a plurality of the pump subassemblies, the subassemblies being disposed in an inline configuration.

According to another embodiment of the invention, the inner end of the pump subassembly is connected to the crankpin such that the inner end can move relative to the crankpin along a fore-and-aft axis so as to main the piston rod collinear to the inner bore.

According to another embodiment of the invention, the inner end of the pump subassembly is connected to the crankpin by a pivoting bearing that the inner end can move relative to the crankpin so as to maintain the piston rod collinear to the inner bore.

According to another embodiment of the invention an ultrahigh pressure pump includes an elongated frame; a cylinder block carried by the frame and including at least one bore formed therein; a crankshaft rotatably mounted in the frame, the crankshaft including an input shaft adapted to be driven by a power source and a crankpin offset from a rotational axis of the crankshaft; at least one pump subassembly including: a pivot block carried by the frame and mounted for linear reciprocal motion between the cylinder block and the crank; a connecting rod having a first end pivotally attached to the pivot block and a second end pivotally attached to the crankpin; and a cylindrical piston rod received in the bore and attached to the pivot block. The piston rod can reciprocate relative to the inner bore in response to rotation of the crankshaft substantially without side loads upon the piston rod.

According to another embodiment of the invention, the pivot block is mounted to the frame by a linear bearing.

BRIEF DESCRIPTION OF THE DRAWINGS

The invention may be best understood by reference to the following description taken in conjunction with the accompanying drawing figures in which:

FIG. 13 is a perspective cut-away view of an alternative high-pressure seal assembly for use with the present invention;

FIG. 14 is an enlarged view of a portion of the high-pressure seal assembly of FIG. 13;

DETAILED DESCRIPTION OF THE INVENTION

Figure 1:
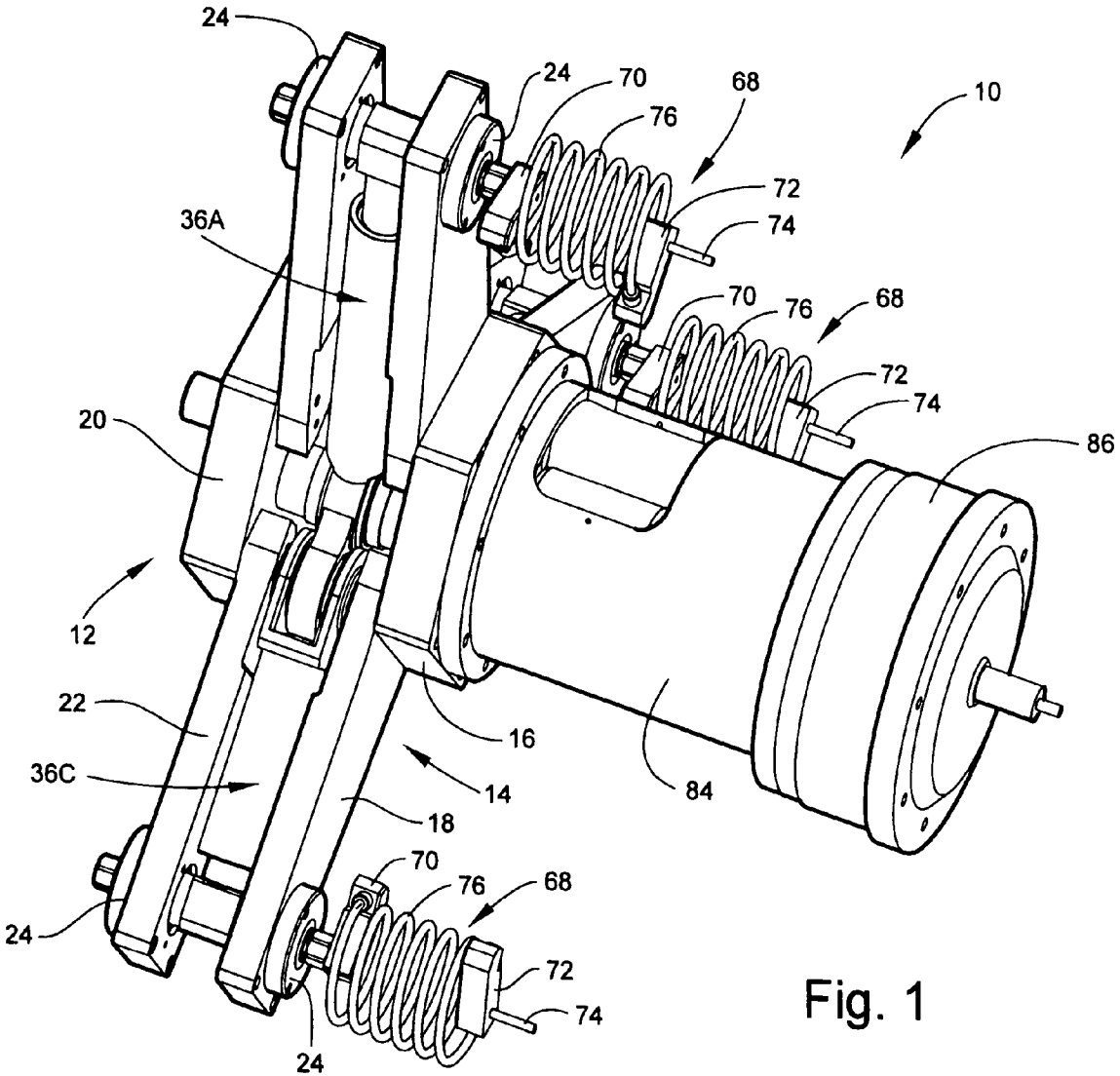
FIG. 1 is a perspective view of an ultrahigh-pressure pump constructed in accordance with the present invention.
Figure 2:
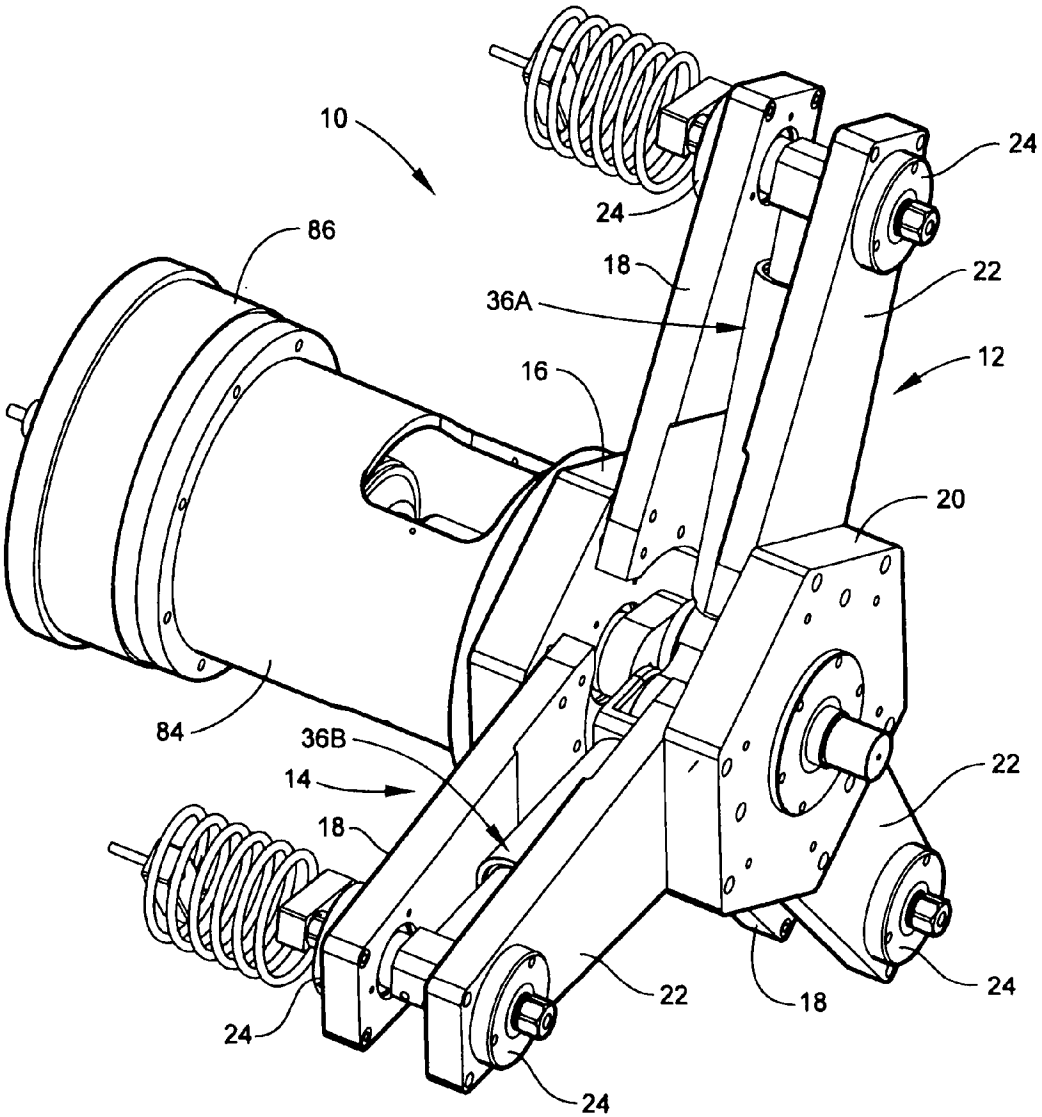
FIG. 2 is another perspective view of the pump of FIG. 1.

Referring to the drawings wherein identical reference numerals denote the same elements throughout the various views, FIGS. 1-4 illustrate an exemplary ultrahigh-pressure pump 10 constructed according to the present invention. The pump 10 includes spaced-apart structural front and rear frames 12 and 14. The rear frame 14 includes a rear hub plate 16 and at least one rear frame arm 18 extending radially outwardly therefrom. The front frame 12 includes a front hub plate 20 and at least one front frame arm 22 extending radially outwardly therefrom. Each of the front and rear frame arms 18 and 22 carries an outer frame pivot 24 near its radially outer end. In the illustrated example, there are three equally-spaced rear frame arms 16 and three equally-spaced front frame arms 22.

Figure 3:
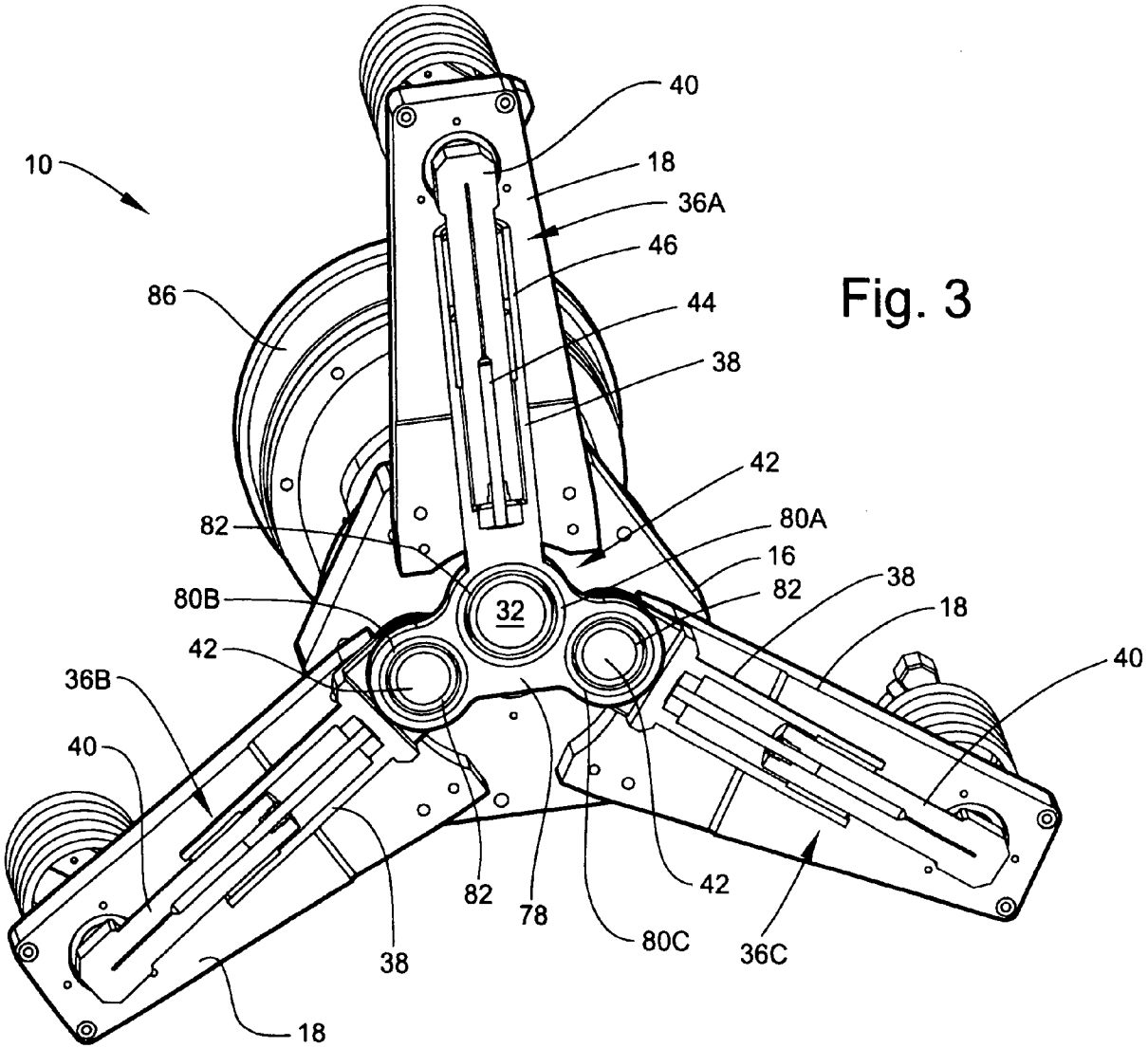
FIG. 3 is a partially cut-away perspective view of the pump of FIG. 1.
Figure 4:
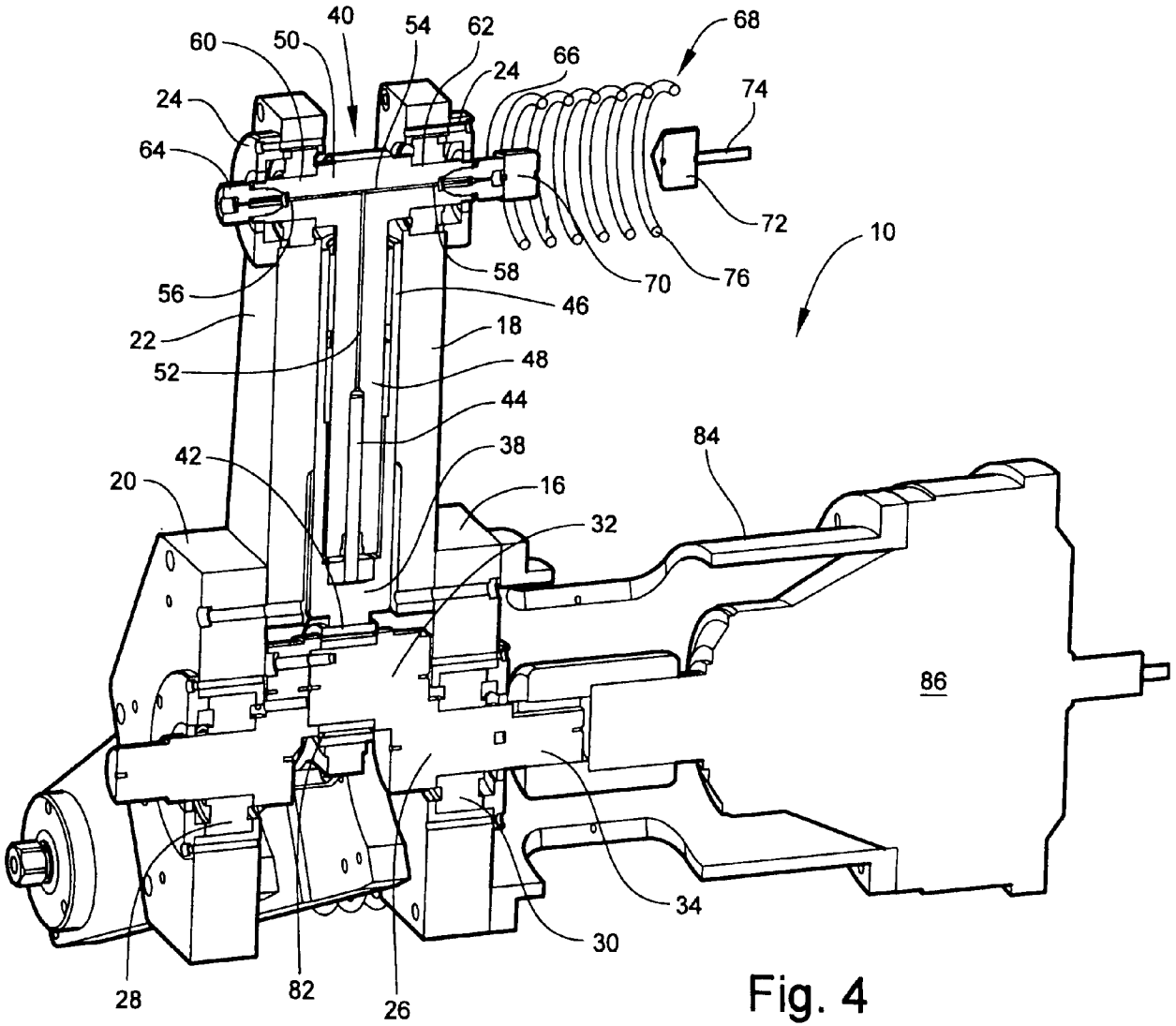
FIG. 4 is a perspective cross-sectional view of the pump of FIG. 1.

As shown in FIGS. 3 and 4, a crankshaft 26 is carried in bearings 28 and 30, for example rolling-element bearings, mounted in the front and rear hub plates 20 and 16, respectively, so that it can freely rotate relative to the front and rear frames 12 and 14. The crankshaft 26 includes an offset crankpin 32. One end of the crankshaft 26 is adapted to be driven by an external power source and is referred to as a input shaft 34.

The pump 10 includes at least one pump subassembly referred to generally at 36. In the illustrated example there are first, second, and third equally-spaced pump subassemblies 36A, 36B, and 36C. A larger or smaller number of pump subassemblies 36 may be used to suit a particular application. Each pump subassembly 36 comprises telescoping inner and outer members 38 and 40. For the purposes of explanation, only the first pump subassembly 36A will be described in detail, with the understanding that it is representative of the construction of the other pump subassemblies 36A and 36B. The inner member 38 has an inner pivot 42 disposed at its radially inner end. A cylindrical piston rod 44 extends radially outwardly from the inner member 38, and a concentric outer sleeve 46 surrounds the piston rod 44.

The outer member 40 is generally "T" shaped and includes a radially-extending cylinder 48 and a crossbar 50. The cylinder 48 has an inner bore 52 formed therein. When assembled, the piston rod 44 fits into the inner bore 52 and the cylinder 48 fits into the outer sleeve 46. The crossbar 50 has an interior crossbore 54 having front and rear ends 56 and 58, which connects to the inner bore 52, and an outer surface which forms front and rear outer pump pivots 60 and 62.

An inlet check valve 64 is installed in fluid communication with the front end 56 of the crossbore 54, and an outlet check valve 66 is installed in fluid communication with the rear end 58 of the crossbore 54, so as to allow flow from the front end of the crossbore 54 to the rear end of the crossbore 54, but to prevent flow in the opposite direction. The inlet check valve 64 is connected to an inlet tube (not shown), for example using a rotary union joint of a known type, and the outlet check valve 66 is connected to a flexible discharge tube assembly 68.

The discharge tube assembly 68 includes a hollow first block 70 connected to the outlet check valve 66, and a hollow second block 72 having a discharge stub 74 which can be connected to appropriate downstream piping. The first and second blocks 70 and 72 are connected by a coiled tube 76. The coiled tube 76 has several complete turns. This accommodates the pivoting motion of the pump subassembly 36 as described below, while keeping the strain in the coiled tube 76 relatively small. This helps prevent failure of the coiled tube 76, especially when it is filled with high-pressure working fluid. A suitable high pressure rotary union could be substituted for the discharge tube assembly 68.

As shown in FIG. 3, the inner pivot 42 of each pump subassembly 36 is connected to the crankshaft 26 through a yoke 78 which is attached to the crankpin 32. The yoke 78 is a "Y"-shaped member including first, second, and third crank pivots 80A, 80B, and 80C. The inner pivots 42 of the second and third pump subassemblies 36B and 36C are attached to the yoke 78 so that they can pivot relative to the yoke 78, for example using rolling-element bearings 82. A provision may be made for ensuring colinearity of the piston rod 44 and cylinder 48. For example, the inner pivots 42 may be mounted to the bearings 82 so that some longitudinal (i.e. fore-and-aft) motion is allowed. Alternatively, the bearings 82 may be of a type which permits some angular displacement to achieve the same purpose. In the illustrated example, the inner member 38 of the first pump subassembly 36A is integrally formed with the yoke 78. Thus, the inner pivot 42 of the first pump subassembly 36A, the first crank pivot 80A, and the crankpin 32 are all coaxial.

In the illustrated example, the pump 10 includes a housing 84 attached to the rear frame 14. The housing 84 carries a speed reducer 86 of a known type which is coupled to the input shaft 34, and adapted to be driven by an electric motor (not shown). Alternatively, any kind of power source could be used to turn the input shaft 34.

Figures 5, 6, 7:
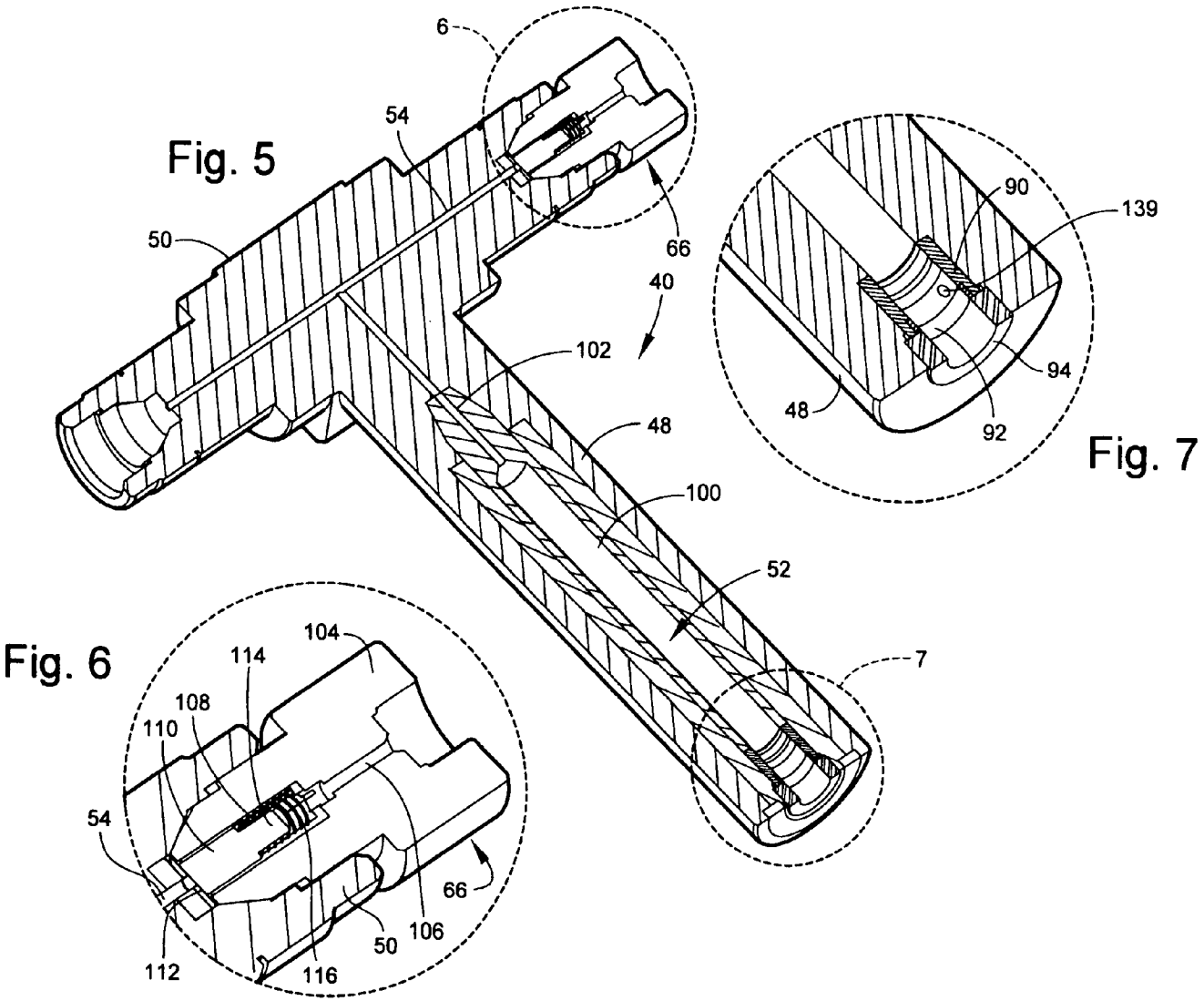
FIG. 5 is a cut-away view of an inner member of a pump subassembly.
FIG. 6 in an enlarged view of a portion of FIG. 5.
FIG. 7 is an enlarged view of another portion of FIG. 5.
Figure 8:
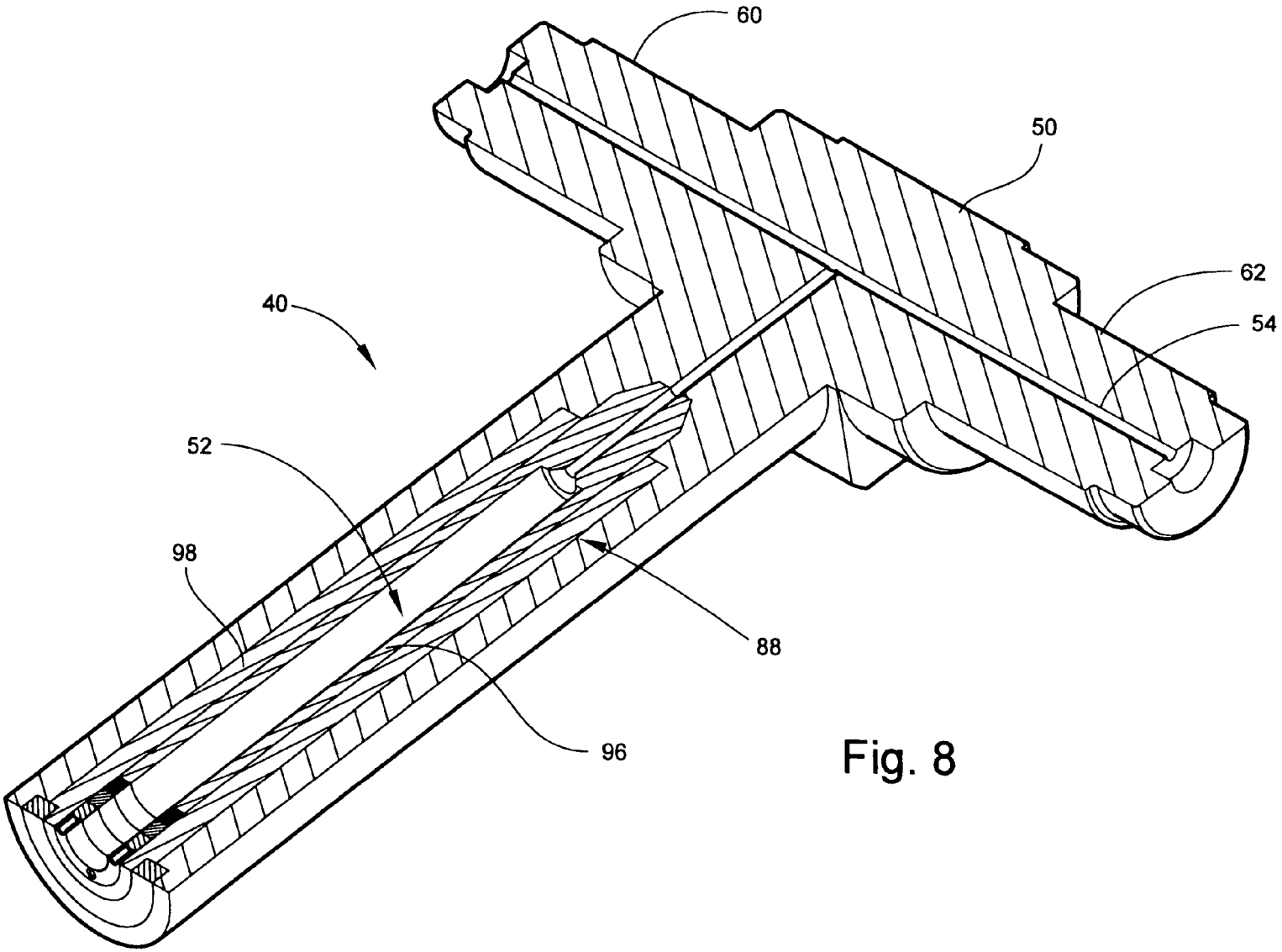
FIG. 8 is another cut-away view the inner member of FIG. 5 showing a liner assembly installed therein.

The outer member 40 is shown in more detail in FIGS. 5 and 8. The cylinder 48 receives a liner assembly 88, a high-pressure seal 90, a low-pressure secondary seal 92, and a locking ring 94. The high-pressure seal 90 may be a resilient seal of a known type, for example a flexible polymer. Preferably, though, it is of a type described more detail below. The secondary seal 92 will trap any water that makes it past the high pressure seal 90 and will force any low pressure leakage flow into the lateral drain path (described below) which leads to an external drain and/or lubrication channel. The liner assembly 88 comprises an inner liner 96 through which the inner bore 52 passes, and an outer liner 98 that is coaxial with the inner liner 96. The inner bore 52 has a lower portion 100 sized to snugly receive the piston rod 44, and a smaller-diameter upper portion 102 which connects to the crossbore 54. There is a controlled interference fit between the inner liner 96 and the outer liner 98, and they are assembled together by known methods such as press fitting or by heating the outer liner 98 to expand it and then placing it over the inner liner 96. This results in the tangential stresses in the inner liner 96 being compressive at the inner bore 52. The stresses in the inner liner 96 will remain compressive until the working pressure in the inner bore 52 exceeds the preload stress. This arrangement resists cracking and failure of the inner liner 96 and is a more efficient use of material than if the cylinder 48 were a unitary structure. This compound construction inner liner 96 and the outer liner 98 may be extended to more than two cylindrical elements. For example, one or more intermediate liners (not shown) could be disposed between the inner liner 96 and the outer liner 98. The inner liner 96 is also longer than the outer liner 98. Therefore, the stress risers present at the termination of the inner and outer liners 96 and 98 are not concentrated at the same location along the length of the cylinder 48.

FIG. 6 illustrates the outlet check valve 66 in more detail. The outlet check valve 66 has a body 104 which is received in the front end of the crossbar 50 of the outer member 40. A central passage 106 is formed through the body 104 and connects to the crossbore 54. A valve chamber 108 houses a moveable plunger 110 which has a sealing face 112 and a protruding stem 114. A return spring 116 is mounted around the stem 114 and urges the sealing face 112 against a valve seat 118 which disposed between the crossbar 50 and the body 106. The valve body 106, plunger 110, and seat 118 are made from a material which offers good resistance to abrasion and wear. One example of a suitable material is a sintered ceramic, or a microgram carbide or Cerbide (ceramic and carbide hybrid material). The inlet check valve 64 is substantially identical in construction to the outlet check valve 66, except that the orientation of its plunger and return spring (not shown) are reversed relative to those of the outlet check valve 66.

Figure 9:
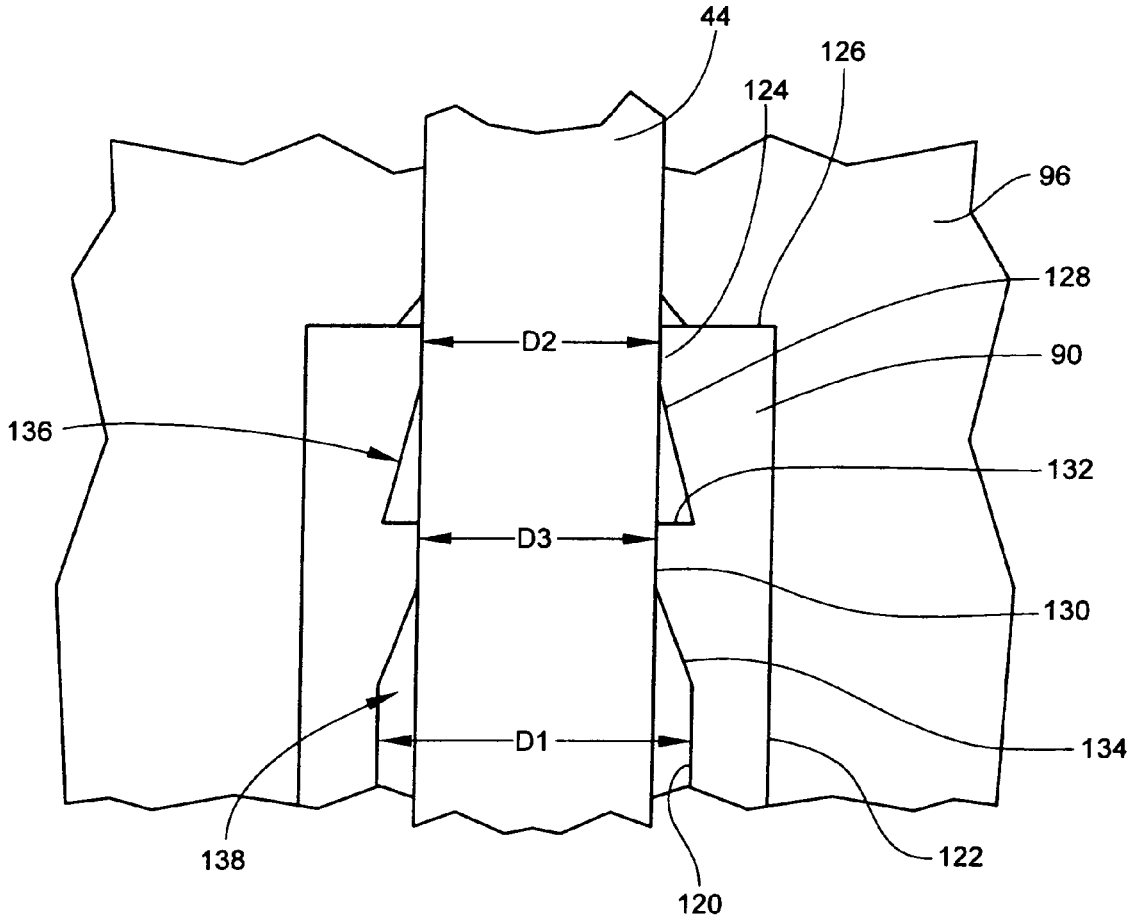
FIG. 9 is an enlarged cross-sectional view of an inner cylinder liner, high-pressure seal, and piston rod.

FIG. 9 shows one preferred construction of the high-pressure seal 90 in more detail. The high-pressure seal 90 is generally cylindrical and has an inner wall 120 and an outer wall 122. The inner wall 120 has a nominal inside diameter "D1" which is larger than the outside diameter of the piston rod 44. The inner wall 120 includes a circumferential surface denoted as a first sealing band 124 having a reduced inside diameter "D2". Diameter D2 is selected to create a slight interference fit between the first sealing band 124 and the piston rod 44. For example, the amount of diametrical interference may be about 0.005 cm (0.002 in.) to about 0.007 cm (0.003 in.) The upper end of the first sealing band 124 joins an axially-facing first annular surface 126, and the lower end of the first sealing band 124 joins a first tapered surface 128 which gradually tapers out to the nominal diameter D1.

The inner wall 120 also includes another circumferential surface denoted as a second sealing band 130 having a reduced inside diameter "D3". Diameter D3 is selected to create a slight interference fit between the second sealing band 130 and the piston rod 44. For example, the amount of diametrical interference may be about 0.005 cm (0.002 in.) to about 0.007 cm (0.003 in.) The upper end of the second sealing band 130 joins an axially-facing second annular surface 132, and the lower end of the second sealing band 130 joins a second tapered surface 134 which gradually tapers out to the nominal diameter D1. The high-pressure seal 88 is constructed from a material having a high resistance to wear. Examples of suitable materials includes a STELLITE cobalt-based alloy, or partially stabilized zirconia, with or without an anti-wear coating applied thereto, such as a hard carbon wear resistance coating.

As noted above, there is a slight interference fit between the first and second sealing bands 124 and 130 and the outer surface of the piston rod 44. This interference condition tends to resist leakage of the high-pressure working fluid. The first and second tapered surfaces 128 and 134 create generally annular first and second relief zones 136 and 138, respectively. The relief zones 136 and 138 collect any working fluid which may leak pass the sealing bands 124 and 130. This bypass flow may be collected through a drain system (not shown) connected to one or more ports 139 which open to the relief zones 136 or 138 and fed back to the pump 10. The flow through the ports 139 may optionally be monitored as a leak detection mechanism. For example, the volumetric flow rate through the drain system may be measured in a known manner. A threshold flow rate may be predetermined based on the degree of acceptable leakage through the high pressure seal 90. If the flow rate exceeds this threshold value, it is an indicator of excessive leakage. Appropriate means may be provided for displaying the actual flow rate and/or alerting a user to the presence of excessive drainage flow. The relief zones 136 and 138 may also be used to hold lubricant, such as oil, delivered through ports (not shown) similar to ports 139, from a lubricant supply (not shown) of a known type, such as a reservoir and pump. The lubricant reduces friction between the piston rod 44 and the high-pressure seal 88, but is isolated from the working fluid to prevent contamination thereof.

FIG. 13 illustrates an alternative embodiment 190 of a high-pressure seal which may be substituted for the high-pressure seal 88. The high-pressure seal 190 is constructed from a material having a high resistance to wear. One example of a suitable material is a STELLITE cobalt-based alloy, with or without an anti-wear coating applied thereto. The high-pressure seal 190 is generally cylindrical and has an inner wall 220 and an outer wall 222. The inner wall 220 has a nominal inside diameter which is larger than the outside diameter of the piston rod 44. The inner wall 220 includes a circumferential surface denoted as a sealing band 224 having a reduced inside diameter selected to create a slight interference fit between the sealing band 224 and the piston rod 44, as described above with respect to the first sealing band 124 of the high-pressure seal 88.

The upper end of the sealing band 224 joins an axially-facing first annular surface 226, and the lower end of the sealing band 224 joins a tapered surface 228 which gradually tapers out to the nominal diameter. The tapered surface 228 creates a generally annular relief zone 230 which collects any working fluid which may leak pass the sealing band 224. This bypass flow may be collected through a drain system (not shown) and fed back to the pump 10. The relief zone 230 may also be used to hold lubricant, such as oil, from a supply (not shown). The lubricant reduces friction between the piston rod 44 and the high-pressure seal 190, but is isolated from the working fluid to prevent contamination thereof.

As shown in FIG. 14, the high-pressure seal 190 also includes an axially-facing second annular surface 232, which is axially displaced from the first annular surface 224. The second annular surface 232 mates against the interior of the inner liner 96. At least one annular groove 234 is formed in the second annular surface 232. Each annular groove 234 receives a resilient seal ring 236, which may be formed from a high-durometer polymer or a similar material. The seal ring 236 serves to prevent leakage past the high-pressure seal 190. The dimensions of the seal ring 236 are chosen so that it is slightly compressed when the high-pressure seal 190 is installed in the inner liner 96. This preload, plus the action of the high-pressure working fluid, tends to drive the seal ring 236 radially outward against an annular wedge surface 238 of the groove 234. This action tends to force the seal ring 236 into a tighter seal and improve its resistance to leakage.

Figure 15:
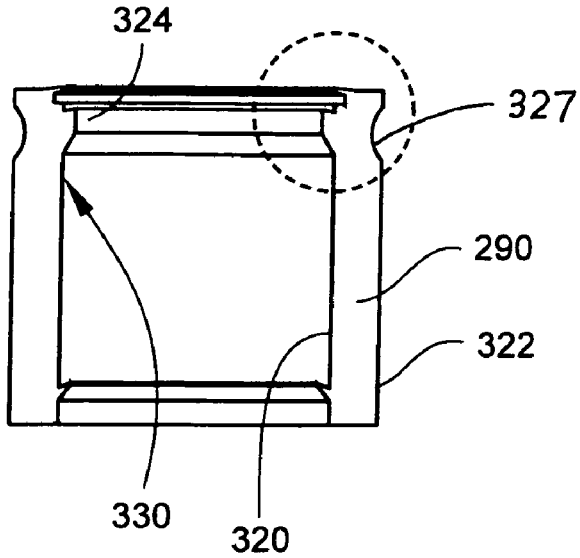
FIG. 15 is a perspective cut-away view of another alternative high-pressure seal assembly for use with the present invention.

FIG. 15 illustrates another alternative embodiment 290 of a high-pressure seal which may be substituted for the high-pressure seal 88. The high-pressure seal 290 is constructed from a material having a high resistance to wear. One example of a suitable material is a STELLITE cobalt-based alloy, with or without an anti-wear coating applied thereto. The high-pressure seal 290 is generally cylindrical and has an inner wall 320 and an outer wall 322. The inner wall 320 has a nominal inside diameter which is larger than the outside diameter of the piston rod 44. The inner wall 320 includes a circumferential surface denoted as a sealing band 324 having a reduced inside diameter selected to create a slight interference fit between the sealing band 324 and the piston rod 44, as described above with respect to the first sealing band 124 of the high-pressure seal 88. The outer wall includes support land 325 disposed around its upper end, which provides an extremely rigid interface between the high-pressure seal 290 and the cylinder 48. This may be an interference-type fit if desired. This ensures minimal motion or deflection when the space which receives the high-pressure seal 290 is pressurized during each pump cycle.

The outer wall also has a concave relief groove 327 formed therein. The relief groove 327 allows for minor dynamic motion adjacent to the sealing band 324, thus allowing the sealing band 324 to engage the piston rod 44 with a predetermined preload, and helps to reduce the effective stiffness of the high-pressure seal 290 in the region of the sealing band 324. The dimensions and shape of the relief groove 327 can be varied to reduce the stiffness of the sealing band 324 to piston rod engagement zone, thereby allowing a prescribed sealing force. The presence of the relief groove 327 allows a reduction in the slope of the deflection to opposing force curve from what would otherwise be required. That is, the high-pressure seal 290 has some flexure versus a rigid, solid wall.

The upper end of the sealing band 324 joins an axially-facing first annular surface 326, and the lower end of the sealing band 324 joins a tapered surface 328 which gradually tapers out to the nominal diameter. The upper surface of the sealing band 324 forms an angle "A" with the longitudinal axis of the high-pressure seal 290. In the illustrated example the angle A is about is 78°, but may be varied depending on the particular application. This angle, as well as the surface area of the axially-facing portion of the sealing band 324, may be varied to allow the working fluid pressure to actually push the sealing band 324 against the piston rod 44. The greater the pressure, the higher the sealing force. The tapered surface 328 creates a generally annular relief zone 330 which collects any working fluid which may leak past the sealing band 324. This bypass flow may be collected through a drain system (not shown) and fed back to the pump 10. The relief zone 330 may also be used to hold lubricant, such as oil, from a supply (not shown). The lubricant reduces friction between the piston rod 44 and the high-pressure seal 290, but is isolated from the working fluid to prevent contamination thereof.

Figure 16:
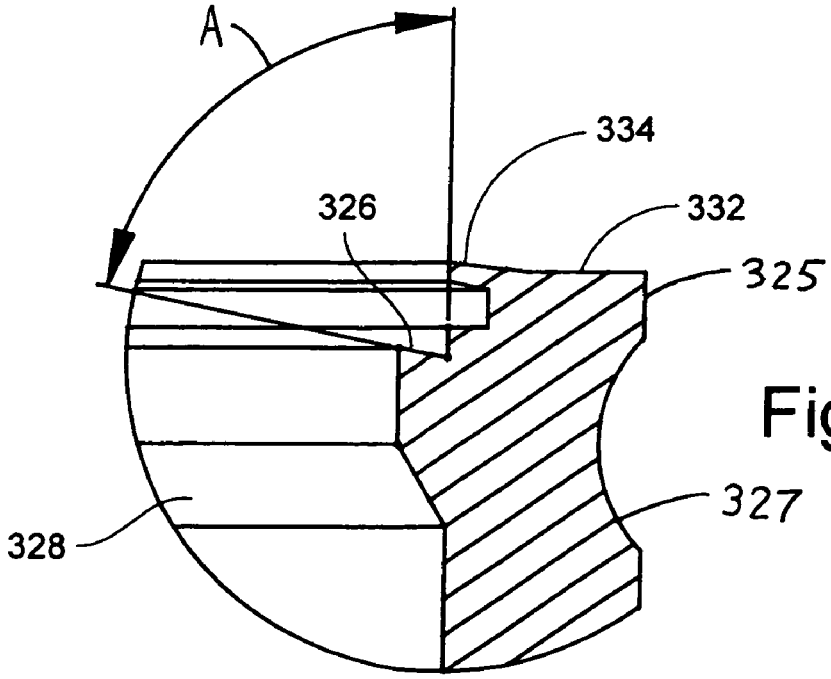
FIG. 16 is an enlarged view of a portion of the high-pressure seal assembly of FIG. 15.

As shown in FIG. 16, the high-pressure seal 290 also includes an axially-facing second annular surface 332, which is axially displaced from the first annular surface 324. The second annular surface 332 mates against the interior of the inner liner 96. An annular, radially-inwardly extending lip 334 is formed in the second annular surface 332 The lip 334 serves to prevent leakage past the high-pressure seal 290. The dimensions of the lip 334 are chosen so that it is slightly compressed when the high-pressure seal 290 is installed in the inner liner 96. This preload, plus the action of the high-pressure working fluid, tends to drive the lip 334 outward against inner liner 96, improve its resistance to leakage, and also ensuring that the lip 334 is in a state of compressive stress. This improves its resistance to fatigue and cracking.

The pump 10 operates as follows. Beginning with the piston rod 44 at a top dead center position (TDC), the crankshaft 26 rotates (for example, clockwise). The inner pivot 42 swings outward to the right (as viewed in FIG. 3) while the piston rod 44 moves radially inward, drawing fluid into the inner bore 52. The pump subassembly 363 is able to pivot in an arc about the outer frame pivot 24 so that the inner pivot 42 is displaced laterally from a radially-aligned position by a distance equal to the offset of the crankpin 32. As the piston rod 44 approaches a bottom dead center position (BDC), the inner pivot swings back into a position in radial alignment with the outer frame pivot 24, and the maximum volume of fluid is contained in the inner bore 52. As the crankshaft 26 continues to rotate, the inner pivot swings out the left and the piston rod 44 moves radially outward, expelling the fluid ahead of it. As the piston rod 44 approaches TDC again, the inner pivot 42 swings back into a position in radial alignment with the outer frame pivot 24. Any lateral force placed on the pump subassembly 36 as the crank cycles is relieved by pivoting motion of the pump subassembly 36. This virtually eliminates any side load between the piston rod 44 and inner bore 52, which increases component life and avoids premature seal leakage. It also allows for a relatively long stroke while maintaining a robust supporting structure, in contrast to a prior art piston and rod arrangement which requires significant clearance for the rod motion.

This configuration, with each pump subassembly 36 operating 120° out of phase from the previous one, allows smooth, efficient pumping action with very low pulsing of the flow. The primary advantage of the robust construction is the ability to provide a required flow and pressure at a much lower operating speed than a prior art ultrahigh pressure crank pump. For example, the crank speed may be about 1/20th of that of a crank pump. The piston rod 44 is larger than the piston of a prior art crank pump, and the stroke is about 3⅓ times greater.

Figure 10:
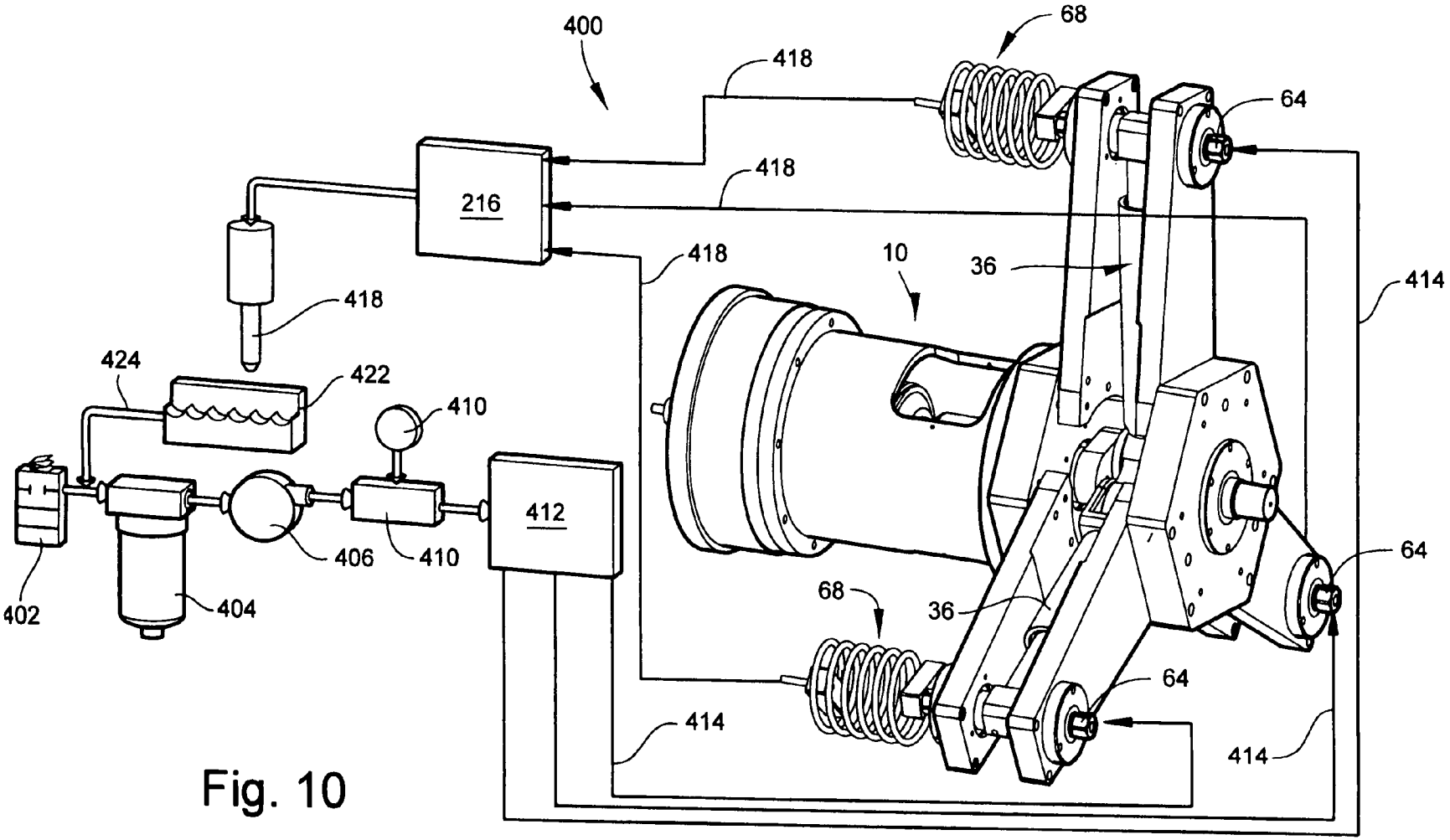
FIG. 10 is a schematic view of a waterjet cutting apparatus utilizing the pump of FIG. 1.

FIG. 10 illustrates schematically a waterjet cutting system 400 utilizing the pump 10 described above. The cutting system 400 includes, in flow sequence, a water supply 402 (e.g. municipal tap water or a tank), a supply filter 404, a low pressure boost pump 406, an optional additive manifold 408 connected to an optional additive pump 410, and an inlet manifold 412. The pump inlet check valve 64 of each pump subassembly 36 is connected to the inlet manifold 412 by a pump supply line 414. The pump outlet check valve 66 of each pump subassembly 36 is also connected to an outlet manifold 416 by a pump discharge line 418. A nozzle 420 is connected to the outlet manifold 416 by appropriate piping. A recovery tank 422 is mounted so as to receive the nozzle discharge flow. A drain line 424 is connected from the recovery tank 422 to the line leading into the supply filter 404.

The waterjet cutting system 400 operates as follows. Water from the water supply 402, the recovery tank 422, or both, passes through the boost pump 406 which increases its pressure and assures constant flow. The water is discharged into the additive manifold 408 where additives such as abrasives may be injected into the water flow by the additive pump 410. The water then passes through the inlet manifold 412 and the pump supply lines 414 into the pump 10 where its pressure is increased to an ultrahigh level, for example about 207 MPa (30,000 psi), as described in detail above. The pump discharge is directed through the pump discharge lines 408 and the outlet manifold to the nozzle 420. The nozzle 420 discharges a focused, ultrahigh-pressure discharge stream which can be used for purposes such as cutting a workpiece (not shown). The waste water is then collected in the recovery tank 422. Some or all of the recovered water may be reused through the pump cycle again.

Figure 11:
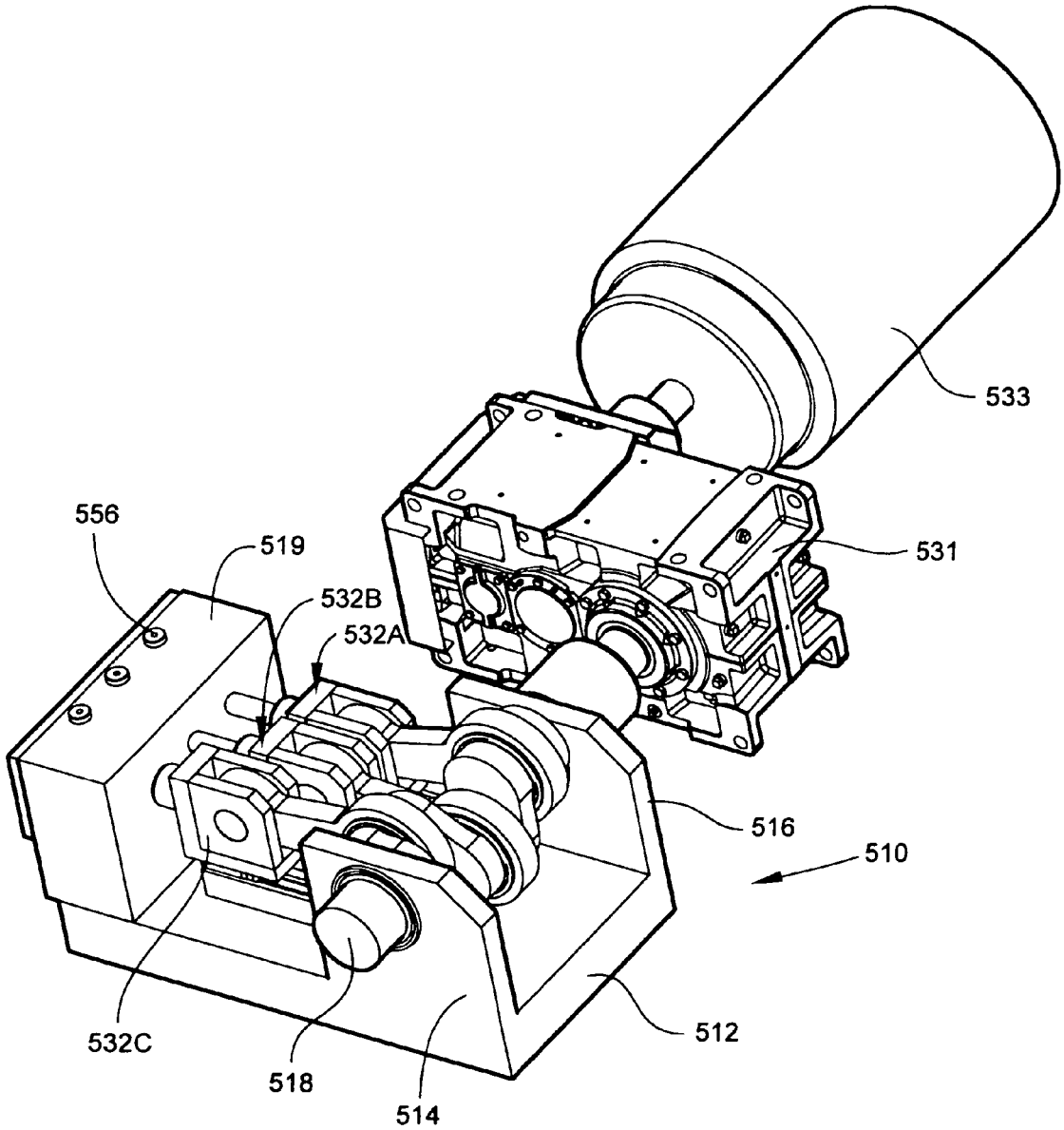
FIG. 11 is a schematic perspective of a pump constructed according to an alternative embodiment of the present invention.

FIG. 11 illustrates an alternative pump 510. The pump 510 is substantially similar in operating principle to the pump 10 described above, however it has a different structural configuration. The pump 510 includes a structural frame 512, which is a generally flat, elongated member having a pair of spaced-apart bosses 514 and 516 extending from a first end thereof. A cylinder block 519 is mounted to the frame 512 at the opposite end. A crankshaft 518 is carried in bearings 520 and 522, for example rolling-element bearings, mounted in the bosses 514 and 516, respectively, so that it can freely rotate relative to the frame 512. The crankshaft 518 includes offset crankpins 524, 526, and 528. One end of the crankshaft 518 is adapted to be driven by an external power source and is referred to as a input shaft 530. A speed reducer 531 of a known type is coupled to the input shaft 530, and is be driven by an electric motor 533. Alternatively, any kind of power source could be used to turn the input shaft 530.

The pump 510 includes at least one pump subassembly referred to generally at 532. In the illustrated example there are first, second, and third equally-spaced pump subassemblies 532A, 532B, and 532C. A larger or smaller number of pump subassemblies 532 may be used to suit a particular application. For the purposes of explanation, only the first pump subassembly 532A will be described in detail, with the understanding that it is representative of the construction of the other pump subassemblies 532B and 532C. The pump subassembly 532A includes a pivot block 534 which is mounted to the frame 512 by a linear bearing 536 of known type which allows the pivot block 534 to freely slide between the crankshaft 518 and the cylinder block 519, while preventing misalignment or lateral motion thereof. A connecting rod 538 has a first end 540 pivotally mounted on a wrist pin 542 carried in the pivot block 534, and a second end 544 pivotally mounted on one of the crankpins 528. Either or both of the first and second ends 540 and 544 may be mounted in bearings such as the illustrated rolling-element bearings 546 and 548, respectively. A cylindrical piston rod 550 extends radially outwardly from the pivot block 534 and into a bore 552 formed in the cylinder block 519.

Figure 12:
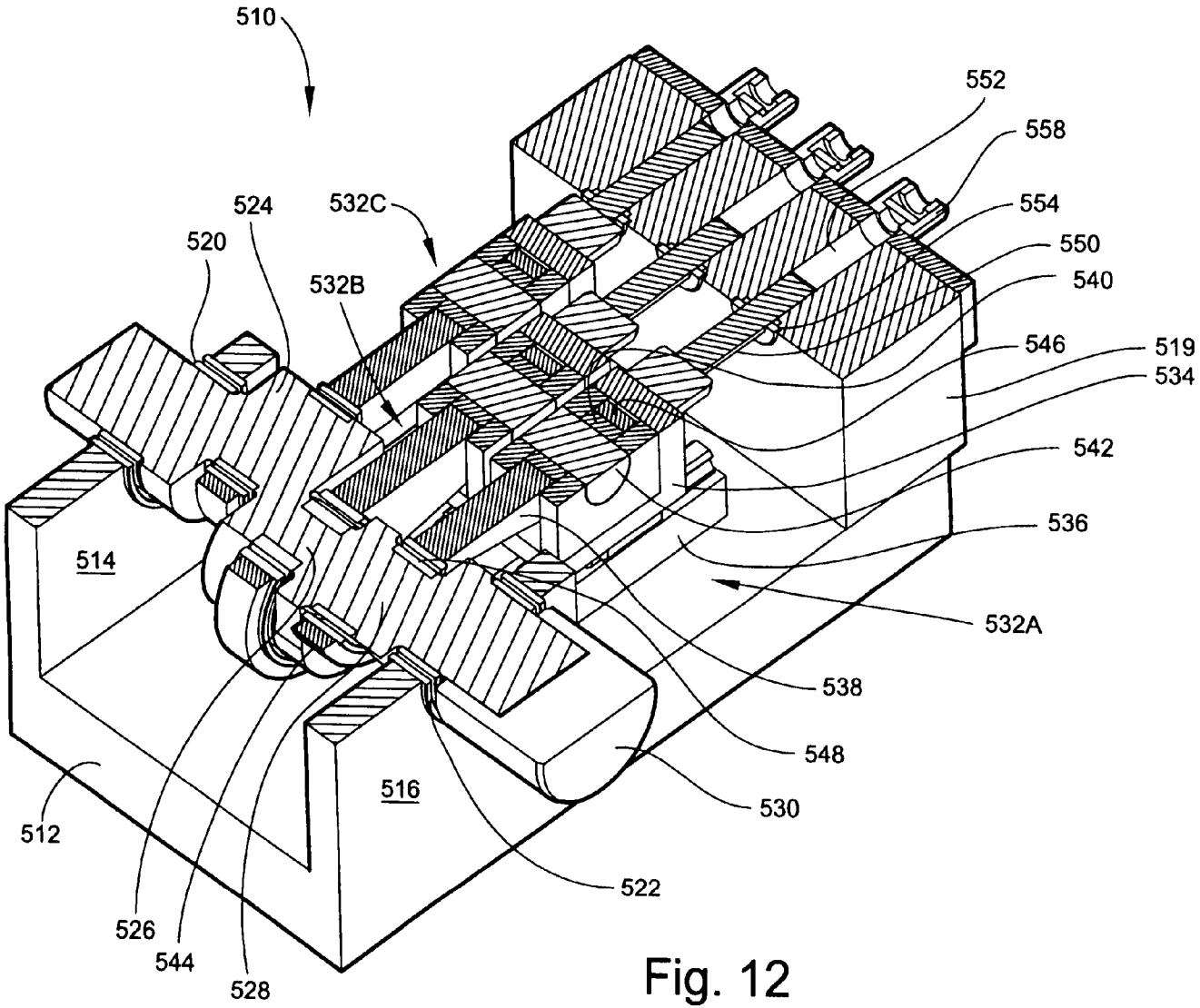
FIG. 12 is a perspective cut-away view of the pump of FIG. 11.

The bore 552 may be a simple cylindrical channel formed in the cylinder block 519. The bore 552 may also be defined by a built-up structure similar to the liner assembly 88 described above (not shown in FIG. 12). A high-pressure seal assembly 554, similar to the high-pressure seal 90 described above, is disposed in the bore 552 to prevent leakage between the piston rod 550 and the bore 552.

An inlet check valve 556 (see FIG. 11) is installed in fluid communication with the bore 552, and an outlet check valve 558 is installed in fluid communication with the end of the bore 552, The inlet check valve 556 is connected to suitable inlet piping (not shown), and the outlet check valve 558 is connected to suitable outlet piping (not shown).

In operation, the crankshaft 518 drives each of the pump subassemblies 532A, 532B, and 532C as it rotates. The arrangement of the pivot block 534 allows the connecting rod 538 to move in a swinging motion with the crankshaft 518, while allowing only rectilinear reciprocating motion of the piston rod 550. Any lateral force placed on the pump subassembly 532A as the crankshaft 518 cycles is relieved by pivoting motion about the wrist pin 542. This virtually eliminates any side load between the piston rod 550 and bore 552, which increases component life and avoids premature seal leakage. It also allows for a relatively long stroke while maintaining a robust supporting structure, in contrast to a prior art piston and rod arrangement which requires significant clearance for the rod motion. The crankpins 524, 526, and 528 may be suitably arranged based on the number of pump subassemblies 532 in this example 120° out of phase, to provide even flow and minimize pressure pulses.

The foregoing has described a ultrahigh pressure pump. While specific embodiments of the present invention have been described, it will be apparent to those skilled in the art that various modifications thereto can be made without departing from the spirit and scope of the invention as defined in the appended claims.

What is claimed is:

1. An ultrahigh pressure pump, comprising:

a frame including at least one radially-extending member having an outer frame pivot disposed at an outer end thereof;

a crank rotatably mounted in said frame, said crank including a driveshaft having an input shaft adapted to be driven by a power source and a crankpin offset from a rotational axis of said crank;

at least one radially-extending telescoping pump subassembly having inner and outer ends and including: a cylinder having an inner bore and a piston rod received in said inner bore, wherein said outer end is carried by said outer frame pivot so as to allow pivotal swinging movement of the pump subassembly about said outer frame pivot, and further wherein the inner bore is in fluid communication with a fluid flow discharge path that is not in fluid communication with any moving element boundary between the outer end of the pump subassembly and the outer frame pivot; and said inner end is pivotally attached to said crankpin, whereby said piston rod can reciprocate relative to said inner bore substantially without side loads thereupon;

wherein said cylinder includes a liner assembly, comprising:

a cylindrical inner liner which defines said inner bore; and a cylindrical outer liner surrounding said inner liner, wherein said outer liner is assembled to said inner liner with a preselected interference fit such that a compressive preload is present in said inner liner.

2. The pump of claim 1 wherein each of said pump subassemblies includes:

an outer member having an inner end and an outer end, said outer end carrying an outer pump pivot and said inner end defining the cylinder having the liner assembly therein; and a inner member having an inner pivot disposed at a radially inner end thereof, the radially outwardly extending piston rod, and a coaxial outer sleeve surrounding said piston rod in spaced-apart relationship thereto, wherein said piston rod is received in said inner bore and said cylinder is received in said outer sleeve.

3. The pump of claim 2 wherein said outer member further includes:

a laterally-extending crossbar disposed at a radially outer end of said cylinder, said crossbar having a crossbore formed therethrough with an inlet at one end and an outlet at the other end, said crossbore being disposed in fluid communication with said inner bore;

an outlet check valve disposed in fluid communication with a first end of said crossbore and operative to allow fluid flow in a discharge direction but to prevent fluid flow in an opposite direction; and an inlet check valve disposed in fluid communication with a second end of said crossbore and operative to allow fluid flow in an intake direction but to prevent fluid flow in an opposite direction.

4. An ultrahigh pressure pump, comprising:

(a) a frame including at least one radially-extending member having an outer frame pivot disposed at an outer end thereof;

(b) a crank rotatably mounted in said frame, said crank including a driveshaft having an input shaft adapted to be driven by a power source and a crankpin offset from a rotational axis of said crank;

(c) at least one radially-extending telescoping pump subassembly having inner and outer ends and including: a cylinder having an inner bore and a piston rod received in said bore, wherein said outer end is attached to said outer frame pivot for pivotal swinging movement thereabout, and said inner end is pivotally attached to said crankpin, whereby said piston rod can reciprocate relative to said inner bore substantially without side loads thereupon, wherein each of said pump subassemblies includes:

(i) an outer member having an inner end and an outer end, said outer end carrying an outer pump pivot and said inner end defining the cylinder having the inner bore formed therein; said outer member including:

(A) a laterally-extending crossbar disposed at a radially outer end of said cylinder, said crossbar having a crossbore formed therethrough with an inlet at one end and an outlet at the other end, said crossbore being disposed in fluid communication with said inner bore; and (B) an outlet check valve disposed in fluid communication with a first end of said crossbore and operative to allow fluid flow in a discharge direction but to prevent fluid flow in an opposite direction; and an inlet check valve disposed in fluid communication with a second end of said crossbore and operative to allow fluid flow in an intake direction but to prevent fluid flow in an opposite direction; and (ii) a inner member having an inner pivot disposed at a radially inner end thereof, the radially outwardly extending piston rod, and a coaxial outer sleeve surrounding said piston rod in spaced-apart relationship thereto, wherein said piston rod is received in said inner bore and said cylinder is received in said outer sleeve; and (d) a discharge tube assembly connected in fluid communication with said outlet check valve and said first end of said crossbore, said discharge tube assembly comprising:

(i) a hollow first block rigidly coupled to said pump subassembly;

(ii) a hollow second block spaced away from said first block; and (iii) a tube connecting said first and second blocks, said tube being formed into a coil having a plurality of turns, such that said first block may move relative to said outer frame pivot in unison with said pump subassembly while said second block remains stationary.

5. The pump of claim 1 wherein said inner liner has a length which is greater than that of said outer liner.

6. An ultrahigh pressure pump, comprising:

(a) a frame including at least one radially-extending member having an outer frame pivot disposed at an outer end thereof (b) a crank rotatably mounted in said frame, said crank including a driveshaft having an input shaft adapted to be driven by a power source and a crankpin offset from a rotational axis of said crank;

(c) at least one radially-extending telescoping pump subassembly having inner and outer ends and including: a cylinder having an inner bore and a piston rod received in said bore, wherein said outer end is attached to said outer frame pivot for pivotal swinging movement thereabout, and said inner end is pivotally attached to said crankpin, such that said piston rod can reciprocate relative to said inner bore substantially without side loads thereupon; and (d) a high-pressure seal carried at a radially inner end of said cylinder for preventing fluid leakage between said piston rod and said inner bore, said high-pressure seal including an inner wall having a first diameter larger than an outside diameter of said piston rod, said inner wall comprising:

(i) a circumferential first sealing band having a second diameter smaller than said outside diameter of said piston rod, so as to create a preselected interference between said first sealing band and said piston rod;

(ii) an axially-facing first annular surface joined to an upper end of said first sealing band; and (iii) an angled, circumferential first tapered surface joined to a lower end of said first sealing band, so as to define an annular first relief zone between said piston rod and said first tapered surface.

7. The pump of claim 6 wherein said inner wall of said high-pressure seal further includes:

a circumferential second sealing band axially spaced-away from said first sealing band and having a third diameter smaller than said outside diameter of said piston rod, so as to create a preselected interference between said second sealing band and said piston rod;

an axially-facing second annular surface joined to an upper end of said second sealing band; and an angled, circumferential second tapered surface joined to a lower end of said second sealing band, so as to define an annular second relief zone between said piston rod and said second tapered surface.

8. The pump of claim 6 further comprising means for removing working fluid from said first relief zone.

9. The pump of claim 8 further comprising:

a drain system for receiving said working fluid from said first relief zone; and means for quantifying the amount of working fluid removed from said first relief zone.

10. The pump of claim 6 further comprising means for supplying a lubricant to said first relief zone.

11. The pump of claim 1 wherein said pump includes a plurality of said pump subassemblies, said subassemblies being disposed in a radial array around said crank.

12. The pump of claim 1 wherein said pump includes a plurality of said pump subassemblies, said subassemblies being disposed in an inline configuration.

13. The pump of claim 1 wherein said inner end of said pump subassembly is connected to said crankpin such that said inner end can move relative to said crankpin along a fore-and-aft axis so as to main said piston rod collinear to said inner bore.

14. The pump of claim 1 wherein said inner end of said pump subassembly is connected to said crankpin by a pivoting bearing that said inner end can move relative to said crankpin so as to main said piston rod collinear to said inner bore.

* * * * *

UNITED STATES PATENT AND TRADEMARK OFFICE

CERTIFICATE OF CORRECTION

PATENT NO. : 7,661,935 B2
APPLICATION NO. : 11/059856
DATED : February 16, 2010
INVENTOR(S) : Franz W. Kellar et al.

It is certified that error appears in the above-identified patent and that said Letters Patent is hereby corrected as shown below:

Column 3, line 4, change "main" to -- maintain --.

Column 11, line 23, change "a" to -- an --.

Column 12, line 37, insert -- ; -- after "thereof".

Column 14, line 12, change "main" to -- maintain --.

Column 14, line 17, change "main" to -- maintain --.

Signed and Sealed this

First Day of June, 2010

David J. Kappos

David J. Kappos
*Director of the United States Patent and Trademark Office*